US006492607B2

(12) United States Patent
Bruckert et al.

(10) Patent No.: US 6,492,607 B2
(45) Date of Patent: Dec. 10, 2002

(54) RAPID CLOSURE MECHANISM FOR ELECTRICAL CONTACTS

(75) Inventors: Didier Bruckert, Strasbourg (FR); Francis Diebold, Bernardswiller (FR); Olivier Duez, Ottrott (FR); Thierry Sitz, Obernai (FR)

(73) Assignee: Hager Electro, Obernai (FR)

( * ) Notice: Subject to any disclaimer, the term of this patent is extended or adjusted under 35 U.S.C. 154(b) by 0 days.

(21) Appl. No.: 09/782,876

(22) Filed: Feb. 13, 2001

(65) Prior Publication Data

US 2002/0046940 A1 Apr. 25, 2002

(30) Foreign Application Priority Data

Oct. 19, 2000 (EP) ..... 00440285

(51) Int. Cl.[7] ..... H01H 9/20
(52) U.S. Cl. ..... 200/401; 200/425
(58) Field of Search ..... 200/400, 401, 200/425–9

(56) References Cited

U.S. PATENT DOCUMENTS 4,392,036 A * 7/1983 Troebel et al. ..... 200/401 X
4,687,891 A 8/1987 Bartolo et al.
4,740,770 A 4/1988 Lazareth et al.

FOREIGN PATENT DOCUMENTS

| | | |
|---|---|---|
| EP | 0 224 396 A | 6/1987 |
| EP | 0 897 186 A | 2/1999 |
| FR | 2 581 791 A | 11/1986 |

* cited by examiner

*Primary Examiner*—Renee Luebke
(74) *Attorney, Agent, or Firm*—Abelman, Frayne & Schawab

(57) ABSTRACT

A mechanism for the rapid closure of electrical contacts on a modular electrical apparatus includes movable electrical contacts that pivot with respect to a rotatable contact support and are maintained in a rest position by springs. A manually actuated control lever imparts opposing rotary movements to the control lever and the movable contacts. A cam, driven by the control lever, and a finger attached to each movable contact move in paths that intersect when the movable contacts are separated from the fixed contacts. The cam and finger are locked during a portion of control lever rotation before it reaches a stable position wherein the fixed and movable contacts are closed. The contact support continues to travel while a contact spring accumulates energy, which is dissipated only when the cam and finger separate. During a final stage of motion of the control lever, the cam freely rotates relative to the control lever, with its range of motion being limited only by a stop element on the cam.

8 Claims, 15 Drawing Sheets

RAPID CLOSURE MECHANISM FOR ELECTRICAL CONTACTS

FIELD OF THE INVENTION

The present invention relates to a mechanism for the rapid closure of electrical contacts on modular electrical apparatuses, particularly circuit-breakers and differential circuit-breakers. The mechanism is equally suitable for use with single pole, neutral phase, and multi-polar apparatuses.

BACKGROUND OF THE INVENTION

Rapid electrical contact closure mechanisms, such as is disclosed in European Patent EP-0224396, have previously been known. That mechanism principally includes two components, which pivot with a hand operated lever and movable electrical contacts respectively. The components move along paths, which coincide during a fraction of the combined rotation of the components. These components are provided to cooperate in order to lock the movable electrical contact at a distance from the fixed electrical contact during a portion of rotation, before rapid release at the end of the phase of cooperation, and subsequent closure of the contacts at a speed which is independent of the speed applied to the hand lever.

In the system described in EP-0224396, the combined rotational movement between the hand operating lever and the sub-assembly carrying the movable electrical contact causes an individual rotation of each component in the same direction of rotation. Their axes being offset, the components situated one at the periphery of the hand lever and the other at the edge of the sub-assembly carrying the movable electrical contact, advance in opposite directions in the zone in which their trajectories interfere.

To diagram and visualize their movements, the example is used of two circular paths meeting along two lines developing in opposite directions. In this case, the paths intersect twice, in the zone of first contact and in the zone of disengagement leaving the interference zone.

The system disclosed in patent EP-0224396 is based on such a configuration, which has the consequence that when the components intersect, their disengagement results naturally from the opposite directions of the paths of the components.

SUMMARY OF THE INVENTION

The mechanism of the present invention comprises at least one movable electrical contact provided to cooperate with at least one fixed electrical contact, the movable electrical contact being arranged pivotably relative to a contact support, their relative positioning at rest being determined by the action of a contact spring which maintains a correct pressure in order to keep the electrical contacts in a closed position, even when they are worn.

The contact support itself moves with a rotational motion permitting positioning of the movable electrical contact alternatively against and at a distance from the fixed electrical contact, in particular by manual action on a hand operating lever pivoting between two stable positions and causing the rotation of the contact support through a conventional mechanical toggle system.

In the present invention, a control lever, which may be manually actuated, and a movable electrical contact are given a rotational movement in opposite directions, which causes the intersection of the respective paths of two components which converge and move in the same direction.

In this configuration, it is not easy to produce a second intersection of the paths with a view to disengaging the components from one another, due to the limited space which typically exists in the casing of a modular electrical apparatus and because each component is on the path of the other. This is also the result of the existence of an angular travel of given length for the control lever and also for the contacts.

The rapid closure mechanism of the invention meets these particular constraints and consequently has a specific configuration, which is suited to the above-mentioned, particularly kinetic, constraints.

The components of the invention participating in the rapid closure function consist of a cam driven by the hand operating lever, arranged free to rotate through a limited range relative to the latter, and of a finger, which is fixedly attached to the movable electrical contact, the positioning of which relative to the cam and the movable electrical contact respectively is such that the finger and the cam enter into contact when the fixed and movable electrical contacts are spaced by a predetermined residual distance, the cam having an outer surface along which the finger slides when the rotation of the hand lever takes place, of such length and shape that the finger remains locked in rotation during a fraction of rotation of the hand lever less than its residual travel to reach its stable position of closure of the contacts.

The contact support for its part continues its travel, while the contact spring accumulates energy, which it releases rapidly when the cam/finger contact stops, in the final portion of the travel of the hand lever. The cam can then pursue its rotation relative to the hand lever, the angular range being limited by a stop of the hand lever, an elastic element being interposed between the cam and this stop.

Functionally, the relative positioning of the finger and of the cam, their respective shapes and, in particular, the length of the outer surface of the cam, only permit locking of the movable electrical contact or contacts to be obtained.

The possibility for the cam of a residual rotation relative to the hand lever in particular permits absorption of contact wear and also plays a role in their opening.

The same is true of the elastic element which is interposed between the stop and the cam when the latter comes into the proximity of the former, permitting retraction of the cam on opening of the contacts, and preventing failure of rapid closure on their closure.

More precisely, the cam includes a barrel of hollow cylindrical form turning about a central spindle fitted to the center of a drum provided with a radial lever and forming the hand lever, the drum including an aperture arranged substantially opposite the lever and permitting the passage of a radial projection of the cam extending from the barrel, the free end of which broadens and includes an outer surface coaxial with the cylindrical surface of the barrel, the edges of the aperture parallel with the generatrix of the drum forming the stops between which the cam is free to rotate.

This cam, quite simply added to an already existing hand lever and lock structure, can in the same manner be removed if the rapid closure function is not required.

Preferably, the elastic element consists of a leg fixed to the outer surface of the barrel and diverging progressively from it in the direction of its free end, and placed on the side of the cam entering firstly into contact with the finger on closure of the contacts.

This configuration does indeed render the final portion of relative rotation of the cam relatively to the hand operating lever, in the direction of closure of the contacts, elastic. As will be seen in more detail below, this proves necessary to retract the cam on opening of the contacts.

In this case, in fact, as mentioned above, the end of the finger is in the theoretical trajectory assumed by the cam on the opening movement and is able to form an obstacle to the return movement. If this possibility of retraction did not exist, there would therefore be a forced engagement between these two components, risking damaging the system, or at least causing with time wear incompatible with the function to be fulfilled.

Again preferably, the finger, which is fixedly attached to the movable electrical contact is situated between the latter and the hand operating lever and is formed by overmolding the conductive movable electrical contact with an insulating material.

When the rapid closure mechanism is used in a neutral phase product, there is not therefore an insulation problem in the zone of rapid closure, managed in the circumstances by a single cam, and which imposes a certain closeness between the mobile equipments.

In such a neutral phase apparatus, the cam is identical to that of a single phase product, the uter surface of the cam intended to enter into contact with the finger of each movable electrical contact being formed with a sufficient width to cooperate with two fingers simultaneously, ensuring simultaneous tripping of the two phase and neutral movable electrical contacts.

The differences between a single pole apparatus and a neutral phase apparatus are moreover minor, in terms of structure of the mechanism for rapid closure of the contacts. This is a further advantage of the product, in particular in terms of manufacture and lowering production costs.

BRIEF DESCRIPTION OF THE DRAWINGS

The invention will now be described in more detail, with reference to the attached figures in which.

DETAILED DESCRIPTION OF PREFERRED EMBODIMENTS OF THE INVENTION

Figure 1:
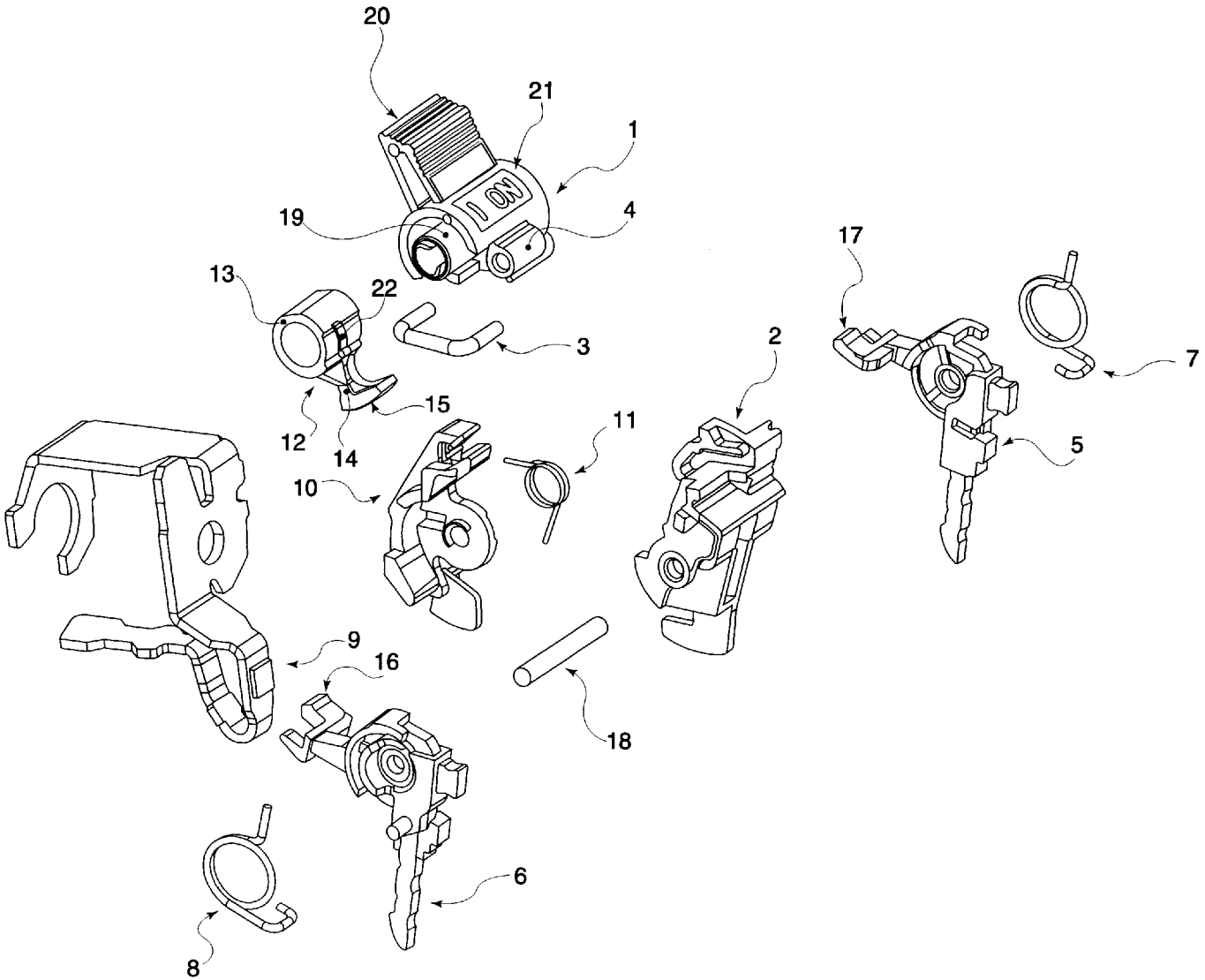
FIG. 1 shows an exploded perspective view of a modular electrical apparatus of the circuit breaker type with its hand operating lever.

With reference to FIG. 1, the different pieces forming part of the operating mechanism of the circuit breaker comprise a hand lever (1) connected to a contact support (2) by a link (3). The hand lever (1), the eccentric housing (4) into which one of the ends of the link (3) is inserted and the latter forming a toggle system permitting control of the displacement of the contact support (2).

The operating mechanism shown here relates to a neutral phase electrical apparatus, it consequently includes two movable electrical contacts (5, 6) mounted to pivot about the axis (18) in the form of a pin which is also the rotation shaft about which the contact support (2) pivots. Contact springs (7) and (8) bias the movable electrical contacts (5) and (6) respectively, each against a corresponding stop of the contact support (2).

The main function of these springs (7, 8) is to maintain the pressure between the contacts even when these are worn. Within the framework of the mechanism for rapid closure of the contacts of the invention, these springs serve to store energy when the movable electrical contacts (5, 6) are immobilized. The fixed contact (9) is fixedly attached to a metal plate forming the yoke of the magnetic trip (not shown).

Figure 2:
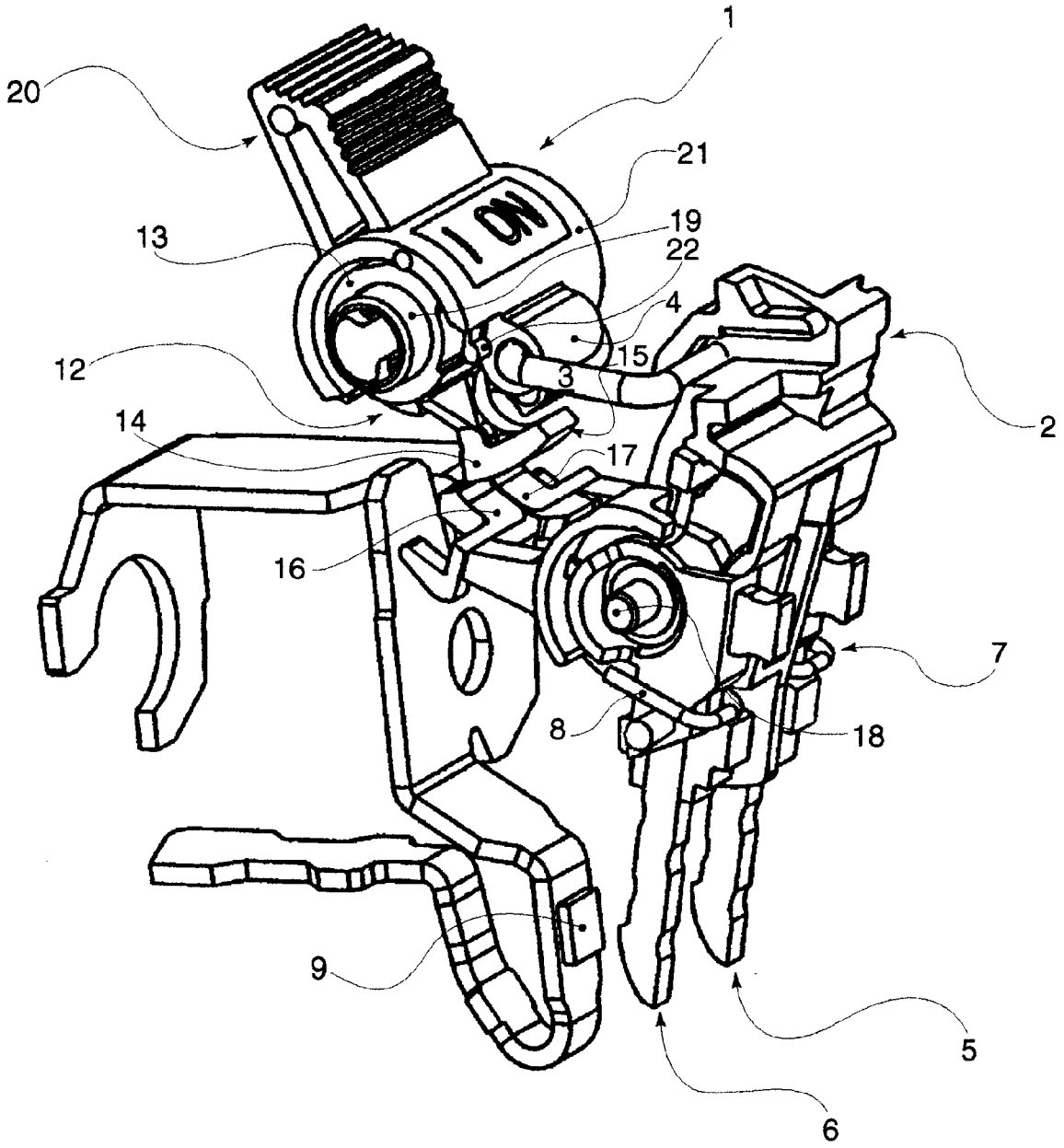
FIG. 2 shows an assembled perspective view of the same elements.

The contact support (2) also supports the trip (10), also mounted to pivot about the pin (18), and including a trip spring (11) returning it into its rest position permitting in particular the jamming of one of the ends of the link (3) in normal operation of the product. The cam (12) of the rapid closure mechanism includes a hollow barrel (13) from which radially extends a projection (14) the outer surface (15) of which is provided to cooperate with fingers (16, 17), which are fixedly attached to the movable electrical contacts (6) and (5) respectively. The same operating mechanism appears in FIG. 2, in an assembled version. The trip (10) is not however shown in this assembly, due to space limitations. This figure reveals the fact that the fingers (16) and (17) are situated close to the projection (14) of the cam (12), and that their free ends can cooperate with the outer surface (15). This is of sufficient width to permit cooperation simultaneously with the two fingers (16) and (17) related to the two-phase and neutral contacts (6) and (5).

This barrel (13) is simply engaged onto the central spindle (19) of the hand lever (1), which guides its rotation. The hand lever is composed more precisely of a lever (20) arranged radially on the periphery of a drum (21) the lower wall of which is cut out in an aperture permitting passage of the projection (14) of the cam (12).

The barrel (13) of the cam (12) also includes an elastic leg (22) giving an elasticity to the final portion of relative rotation of the cam (12) in the hand operating lever (1). The elastic flexion of the leg (22) against the inner wall of the drum (21) provides the final elastic stop.

Figure 3:
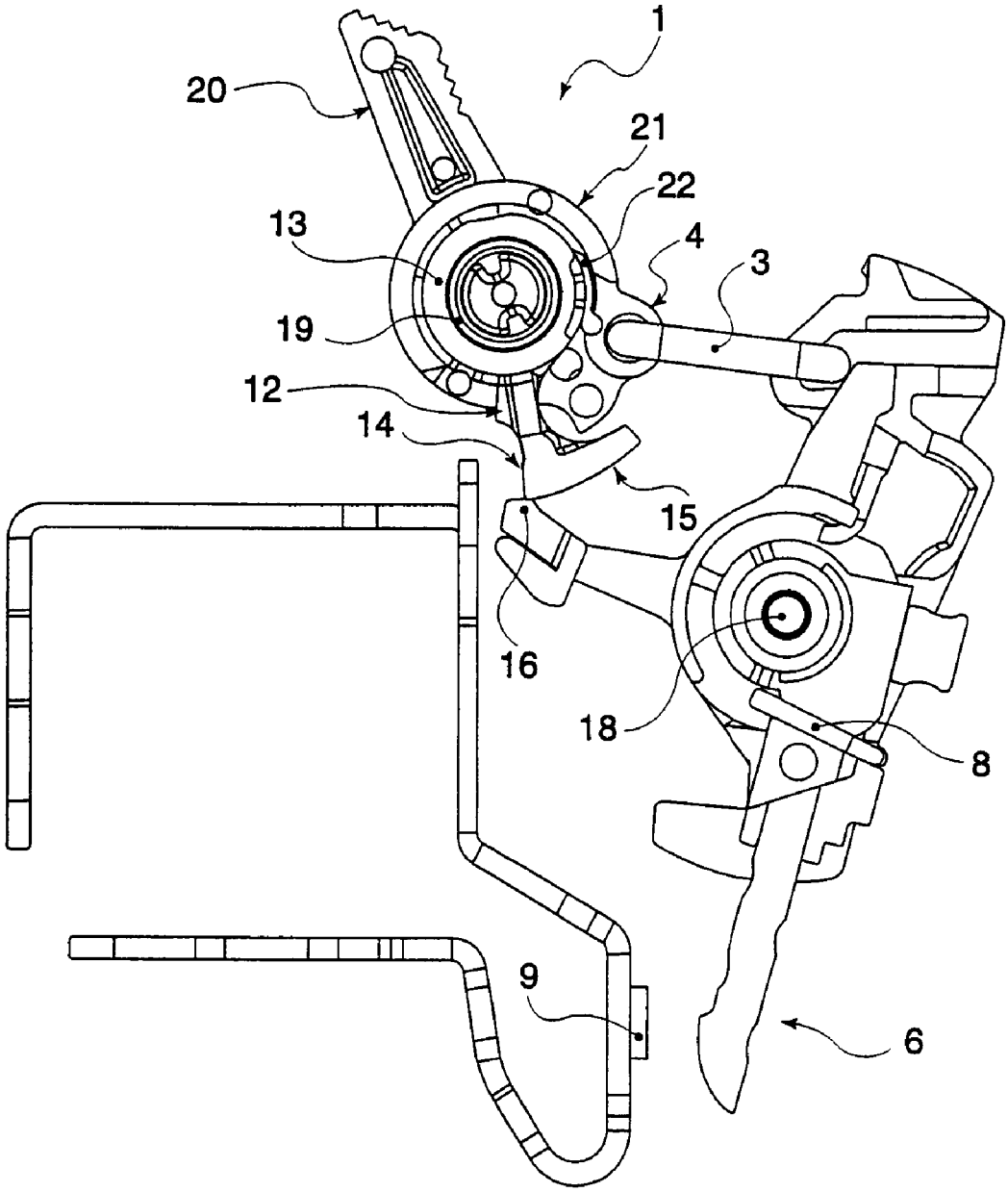
FIG. 3 is a frontal elevation of the same elements, during the phase of maintenance of the movable electrical contact at a distance from the fixed electrical contact before tripping.

In FIG. 3, the free end of the finger (16), which is fixedly attached to the movable electrical contact (6) is in the phase of cooperation with the outer surface (15) of the projection (14) of the cam (12), i.e. the contact (6) is maintained at a fixed distance from the fixed electrical contact (9). The finger (16) is nevertheless at the end of the surface (15), and close to tripping. In fact, the projection (14) being rotated by the hand operating lever (1), while the finger (16) is by definition kept immobile, the projection (14) and in particular the outer surface (15) escapes to the right of the figure, and finally rapidly releases the finger (16), and consequently the movable electrical contact (6). This effects the remainder of its rotational trajectory at high speed, the finger (16) pushing to the right, when it overlaps the peripheral trajectory of the surface (15), the projection (14). Due to the relative free rotation between the barrel (13) and the hand operating lever (1), about the central spindle (19) of the hand lever (1), the projection (14) does not give opposing resistance to the thrust which is applied to it, to the extent of the length of the relative rotational travel which exists between the cam (12) and the hand operating lever, as appears in more detail below.

Figure 4A:
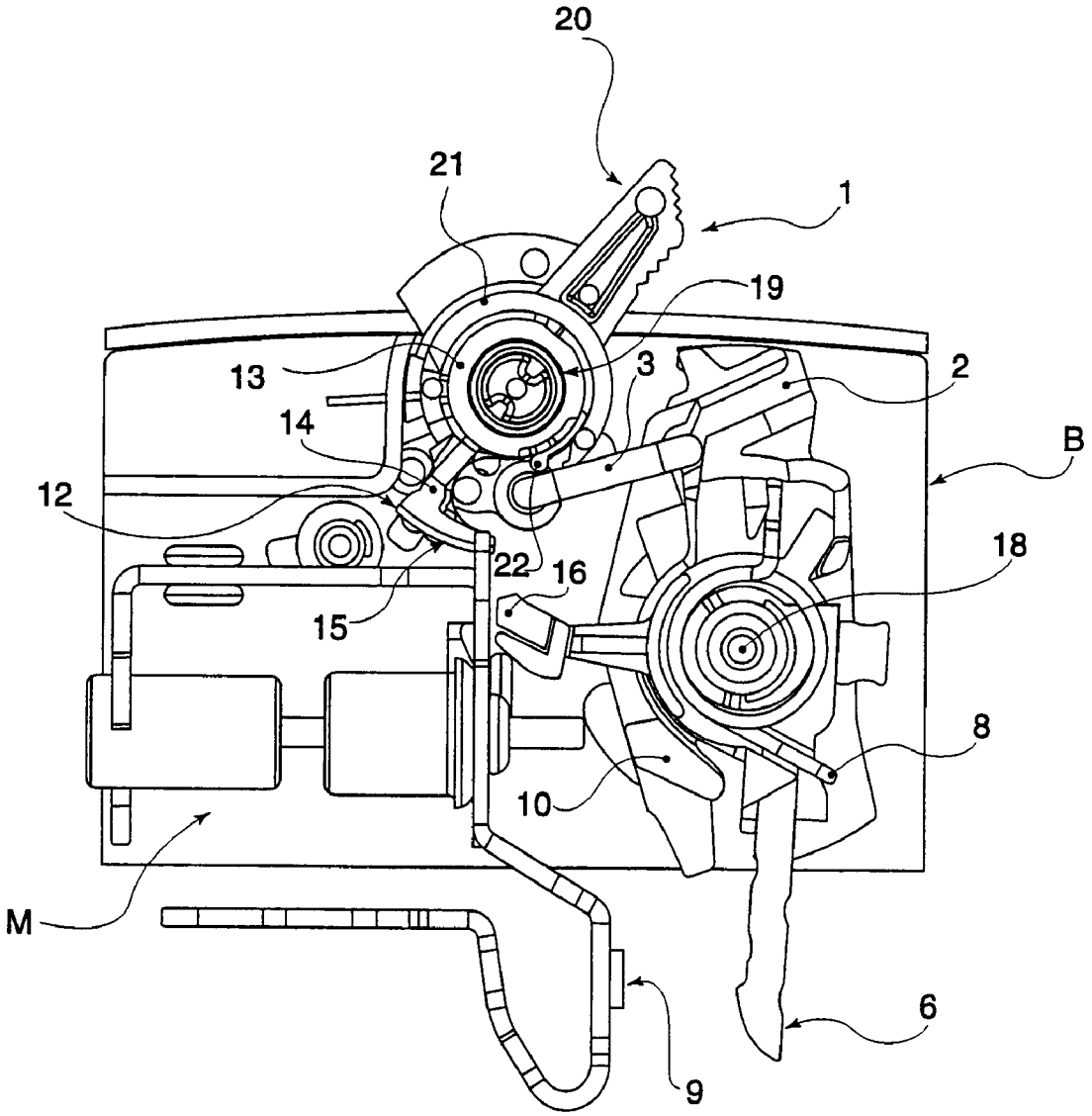
FIGS. 4*a* to 4*g* show a manual closure cycle with. in particular the different phases of cooperation of the components forming the rapid closure mechanism, alternatively with new and worn contacts.

FIGS. 4*a* to 4*g* show a manual closure cycle, alternatively with new contacts and worn contacts. In FIG. 4*a,* the hand lever is shown in its right position, in abutment against one of the lateral edges of an opening in the casing B allowing passage of the lever (20), the contacts (6) and (9) then being separated. It should be noted that, in this position of the hand lever (1), the finger (16), which is fixedly attached to the contact (6), is also situated at a distance from the projection (14) extending beyond the barrel (13) of the cam (12). In this illustration, the magnetic actuator (M) is shown diagrammatically, only the striker, the fixed core and the movable core being shown, with the induction coil omitted.

For opening of the circuit breaker due to a short circuit, the striker is propelled against the trip (10), which causes the toggle system to swivel in order to open the contacts (6, 9) as is, besides, well known.

Figure 4B:
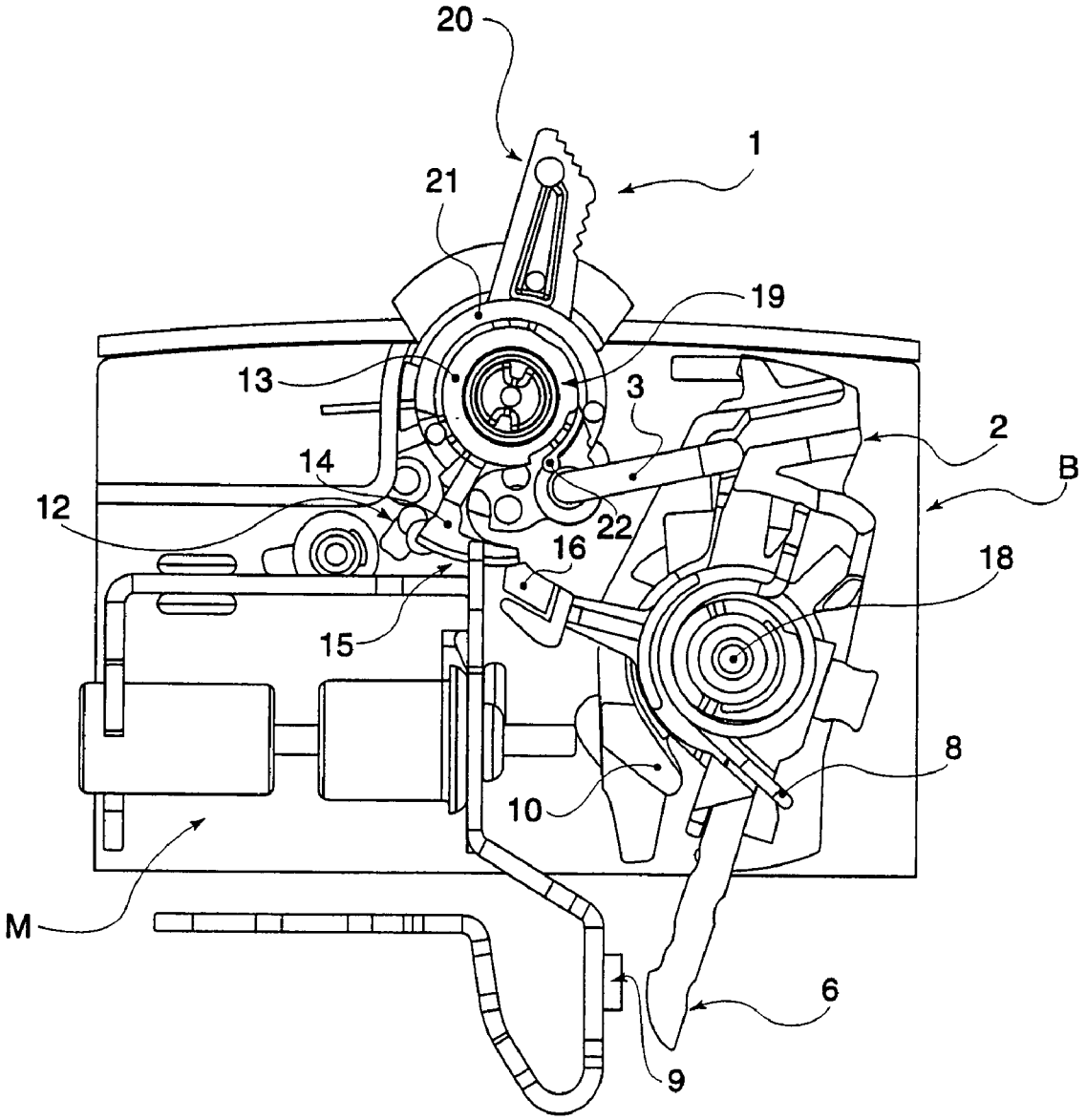
Figure 4C:
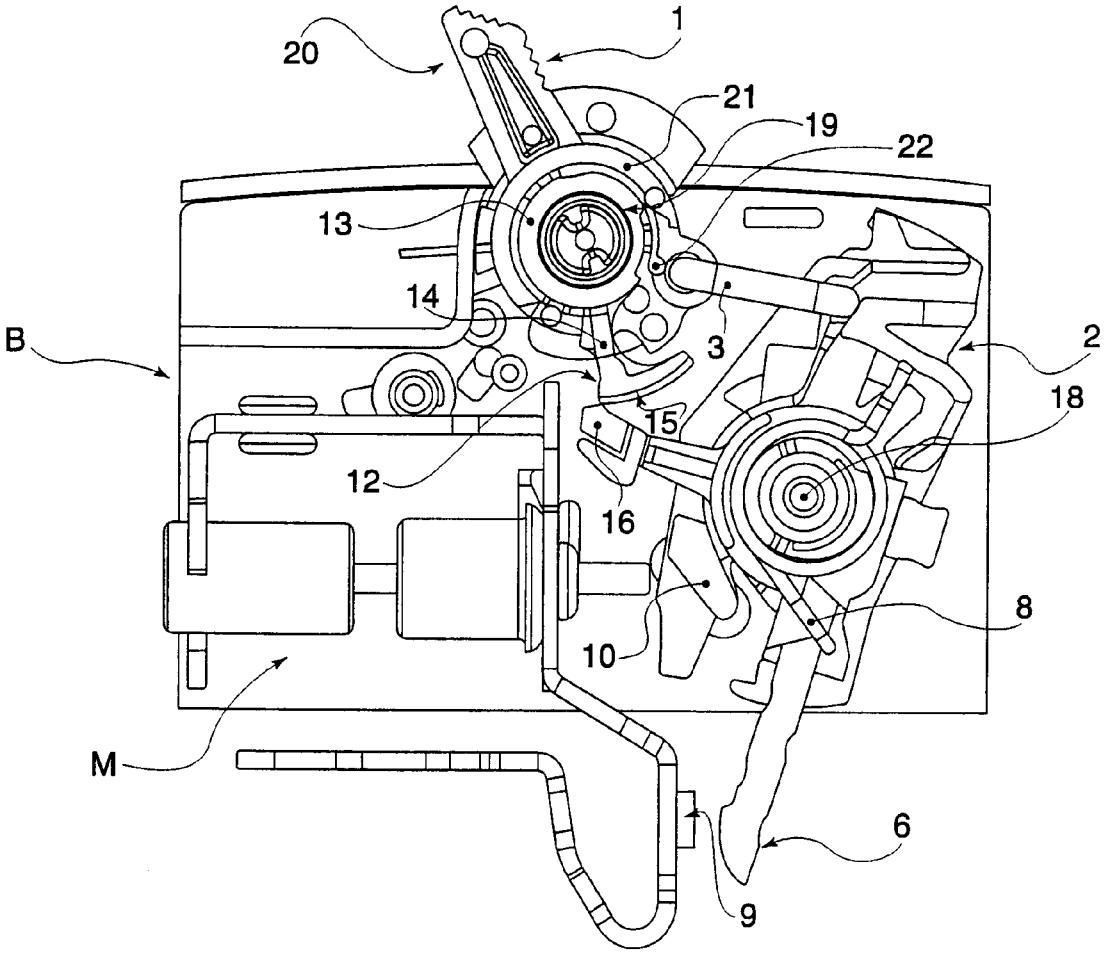

When the hand lever (1) is operated in the direction of closure of the contacts, as shown in FIG. 4*b,* i.e. when it is subjected to a rotation in the counterclockwise direction, the movable electrical contact is rotated clockwise by the contact support (2). In this case, the finger (16) as much as the projection (14) of the cam (12) progress towards each other, substantially in the same direction, until their free ends meet. The finger (16) is then stopped by the outer surface (15) of the projection (14), a relative sliding taking place between the two when the cam (12) continues its rotation as shown in FIG. 4*c.* Thus, while the rotation of the hand operating lever (1) has indeed progressed between FIG. 4*b* and FIG. 4*c,* the movable electrical contact (6) has remained immobile, and at the same distance from the fixed electrical contact (9). Although the cam (12) is free to rotate about the spindle (19), the projection (14) is rotated by one of the lateral edges of the aperture formed in the lower wall of the drum (21) and the cam therefore reflects the effort which is applied to the hand operating lever (1).

Figure 4D:
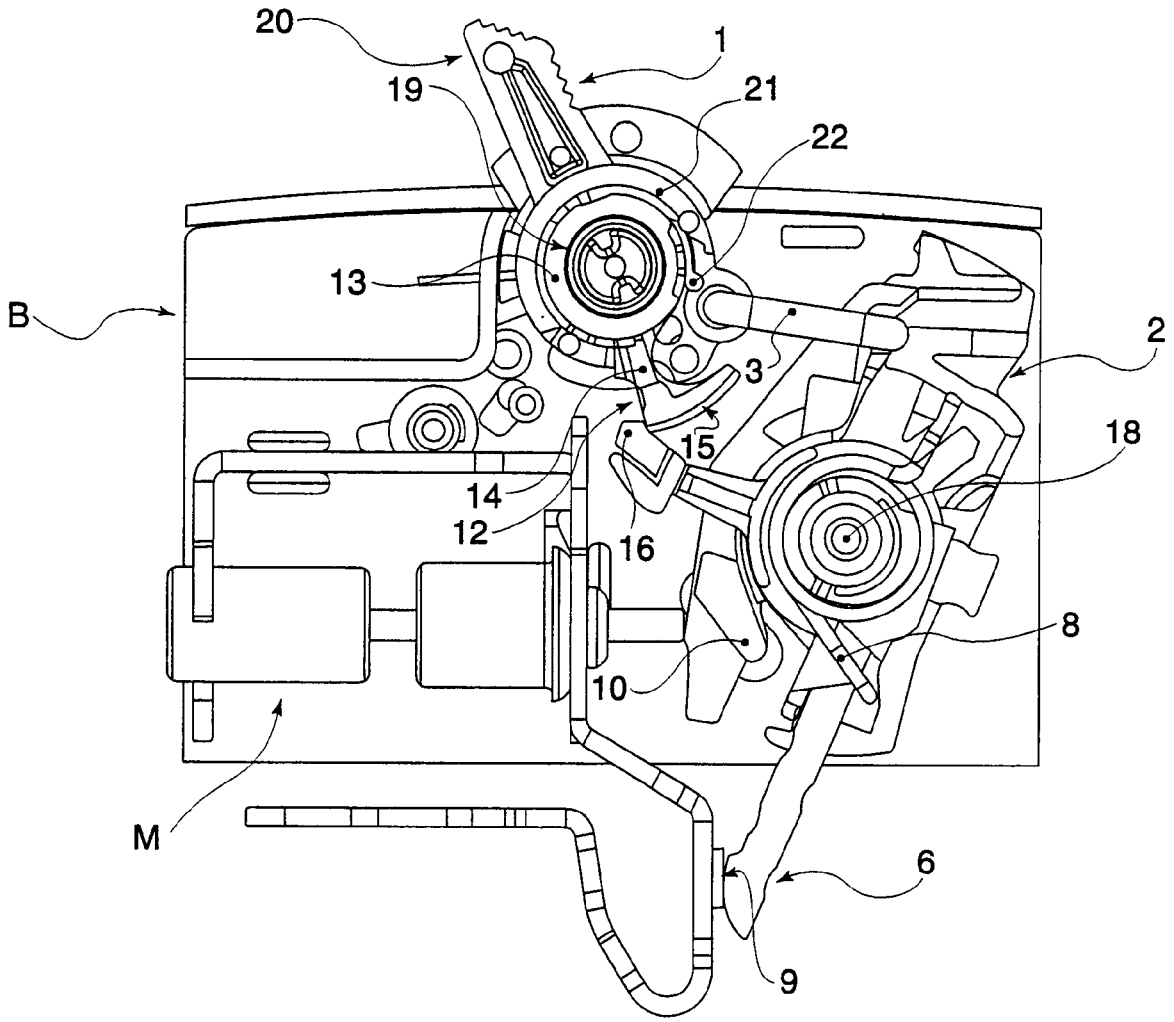
Figure 4E:
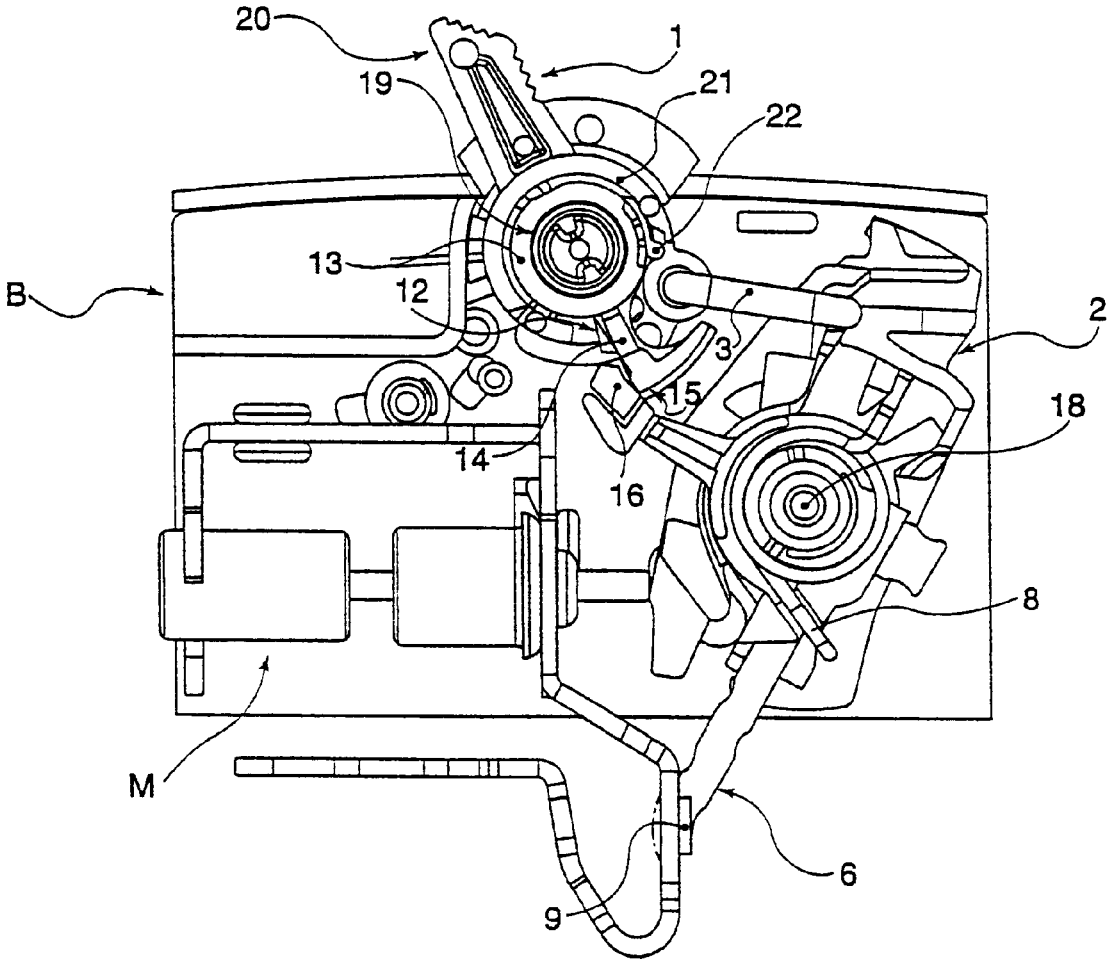

When the finger (16) ceases to be in contact with the outer surface (15) of the projection (14), a rapid tripping takes place as nothing any longer opposes the continued rotation of the movable electrical contact (6), due to the energy stored by the spring (8). The finger (16) then drives back the projection (14) of the cam (12) in the direction of a continuation of its rotation in the counterclockwise direction, which rotation is permitted by the relative freedom to pivot between the cam (12) and the hand operating lever (1). In FIG. 4*d,* the contacts are considered as new, which means that the residual angular travel of the cam (12) relative to the hand lever (1) is limited. Conversely, in FIG. 4*e,* worn contacts are shown, causing a more extended residual travel of the movable contact 6 (shown exaggerated in the figure with the end of the contact depicted in phantom to the left of the fixed contact 9 to enable illustration of the extended travel). In both cases, however, the spring leg (22) does not contribute, as it must allow an additional retraction when the return maneuver is applied to the hand lever. In FIGS. 4*d* and 4*e,* the hand lever (1) is not yet in abutment in its final position, contacts closed.

Figure 4F:
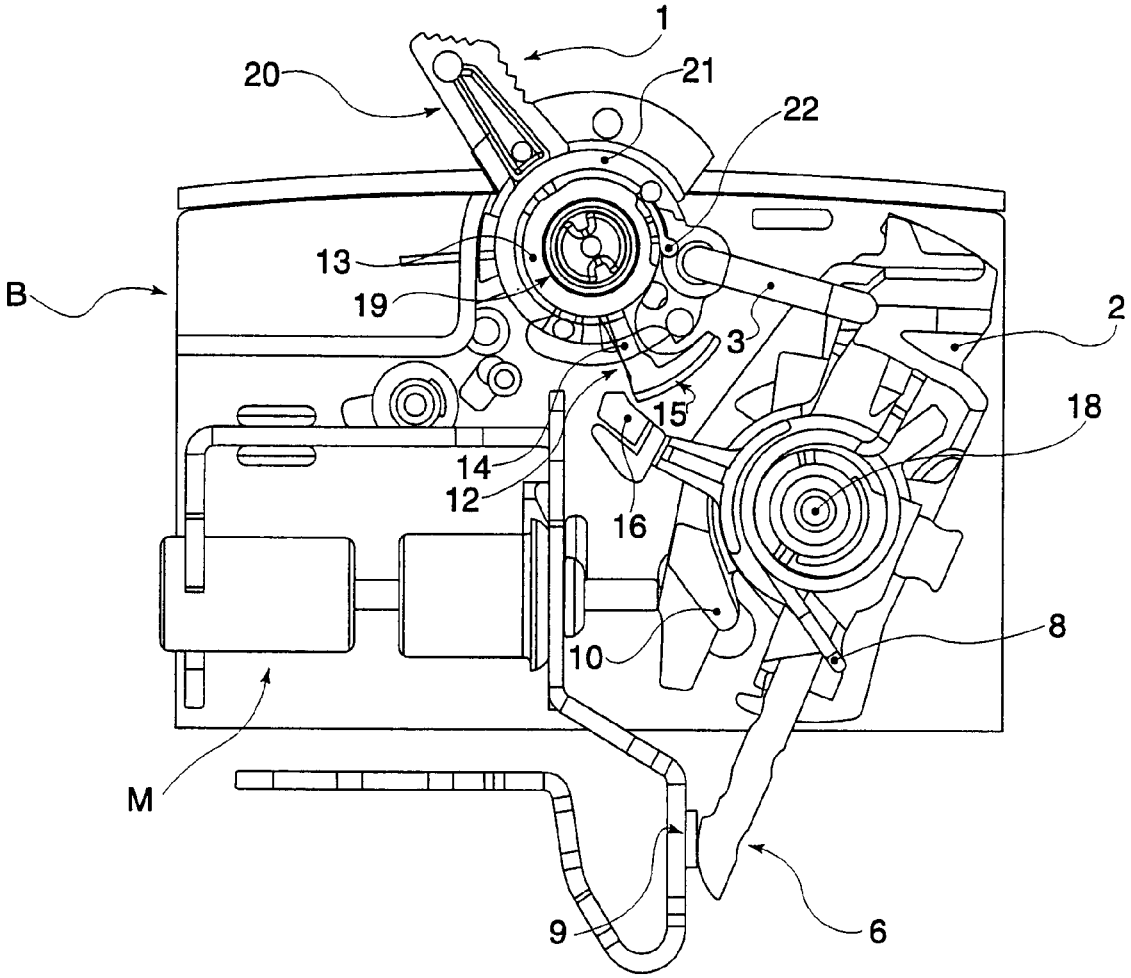
Figure 4G:
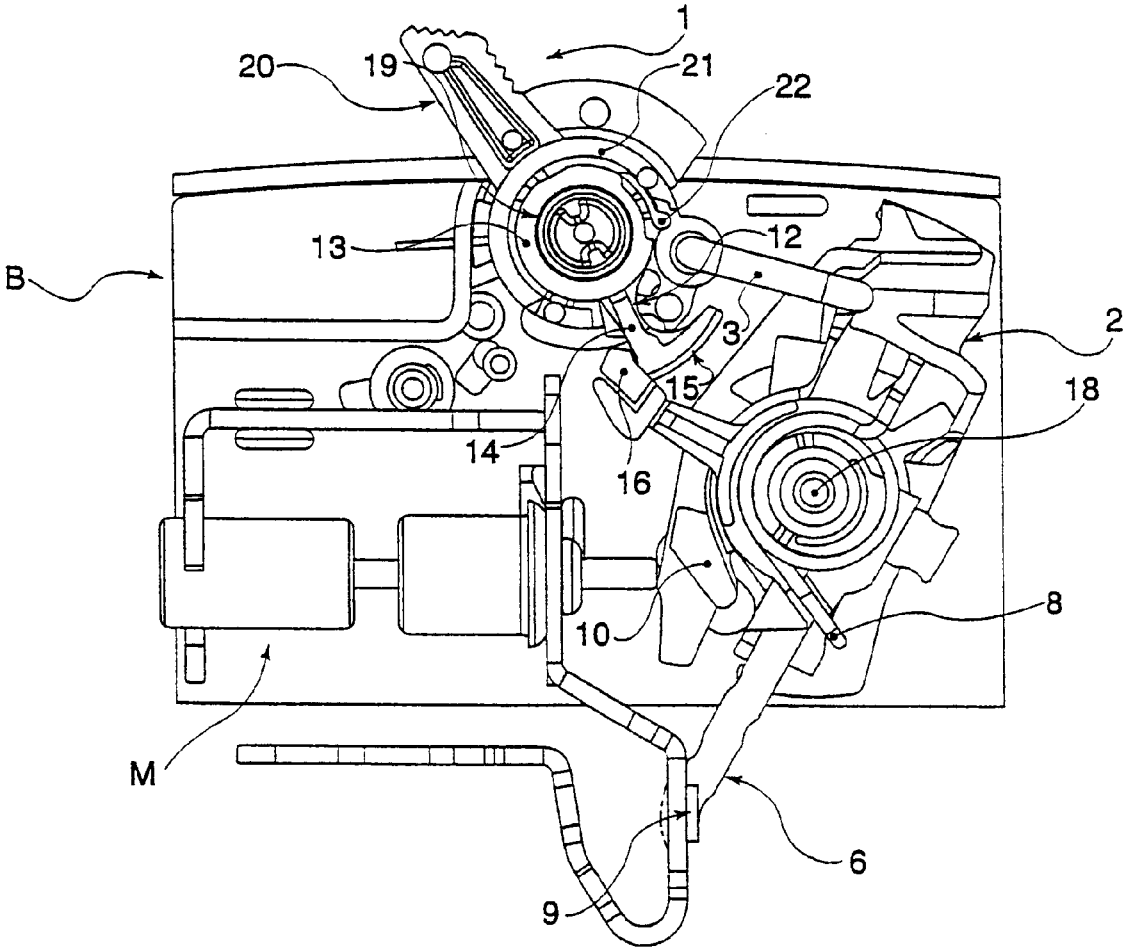

It attains this position in FIGS. 4*f* and 4*g,* with new and worn contacts respectively. In the first case, the energy is restored by the spring (8), communicated to the projection (14) pushed back at a distance from the free end of the finger (16). In the second case, the contacts being worn (the position of the contact 6 being exaggerated and depicted in phantom in FIG. 4*g* as in FIG. 4*e*), there is a configuration in which the leg (22) is in contact with the opposite lateral edge of the aperture formed in the lower wall of the drum (21), while the free end of the finger (16) is still in contact with the rear part of the projection (14). The leg (22) is however not biased in flexion, as the relative rotary range of movement between the cam (12) and the hand operating lever (1) is of course provided to include possible wear of the contacts.

Figure 5A:
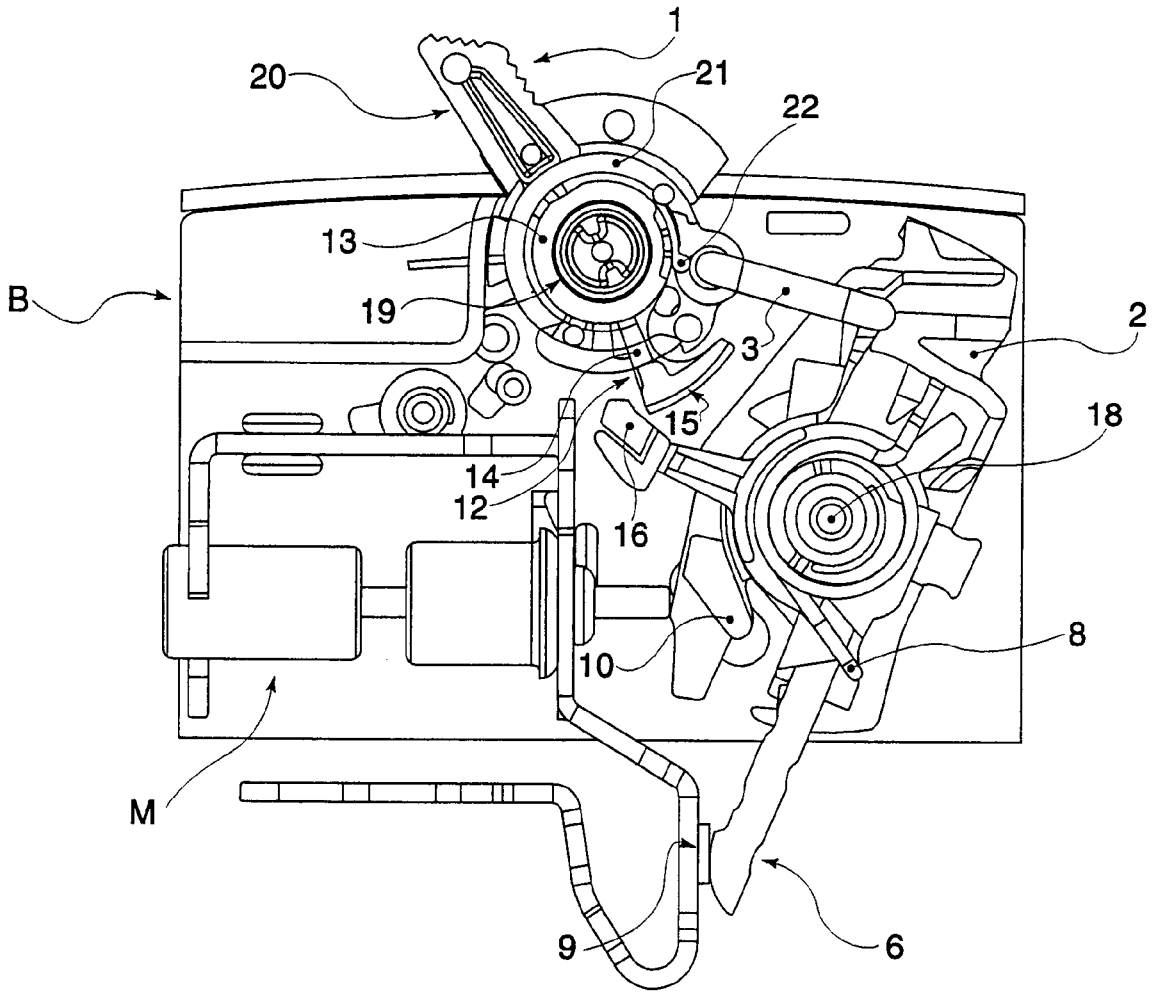
FIGS. 5*a* to 5*e* show a manual opening cycle, with the same elements, and alternatively new and worn contacts.
Figure 5B:
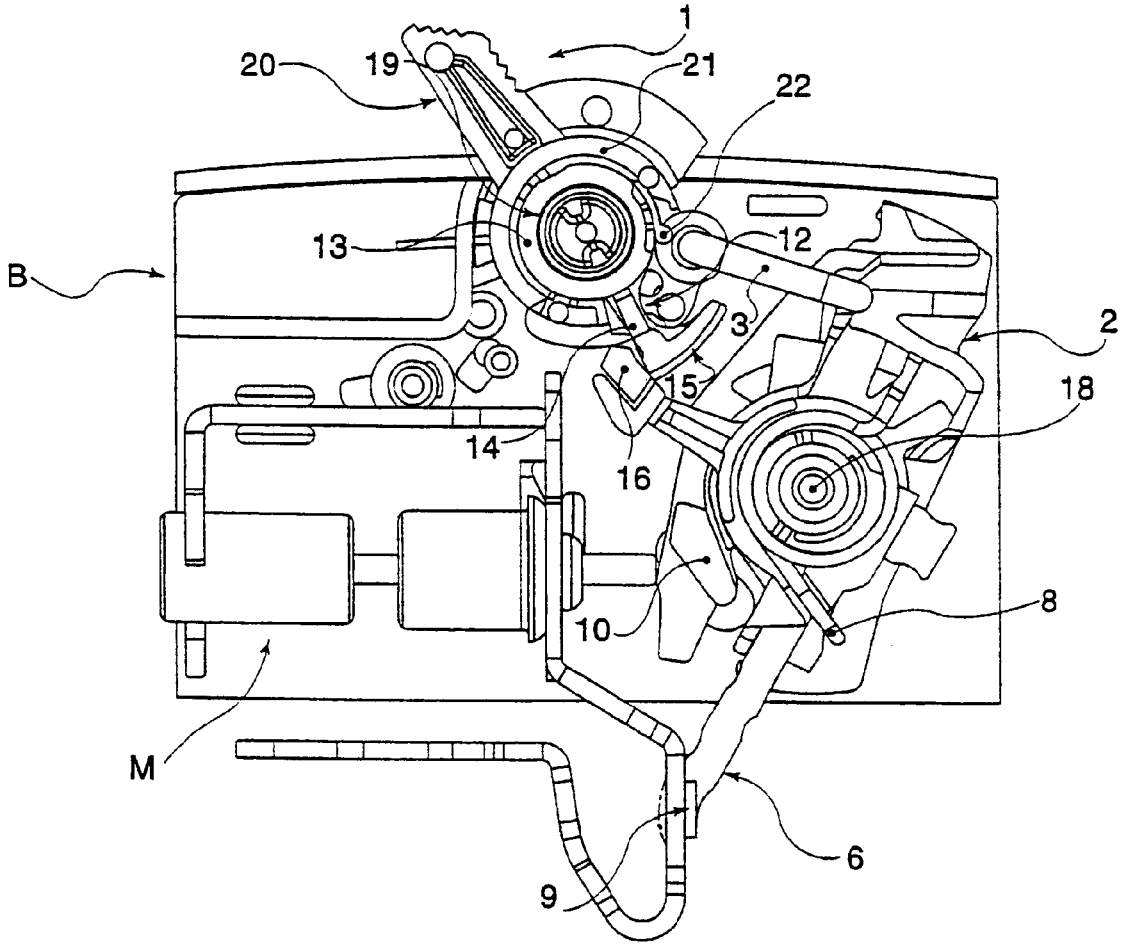
Figure 5C:
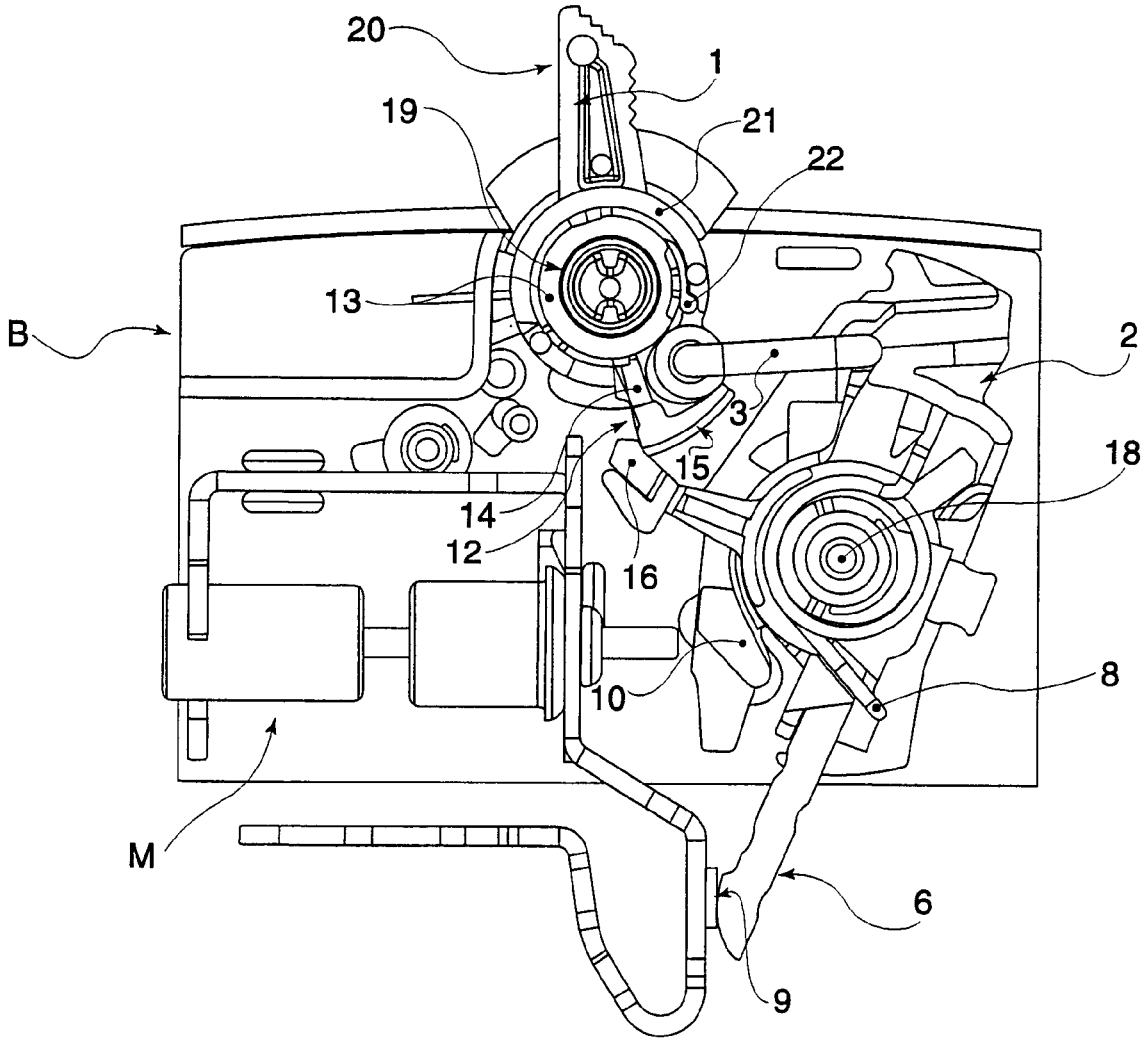
Figure 5D:
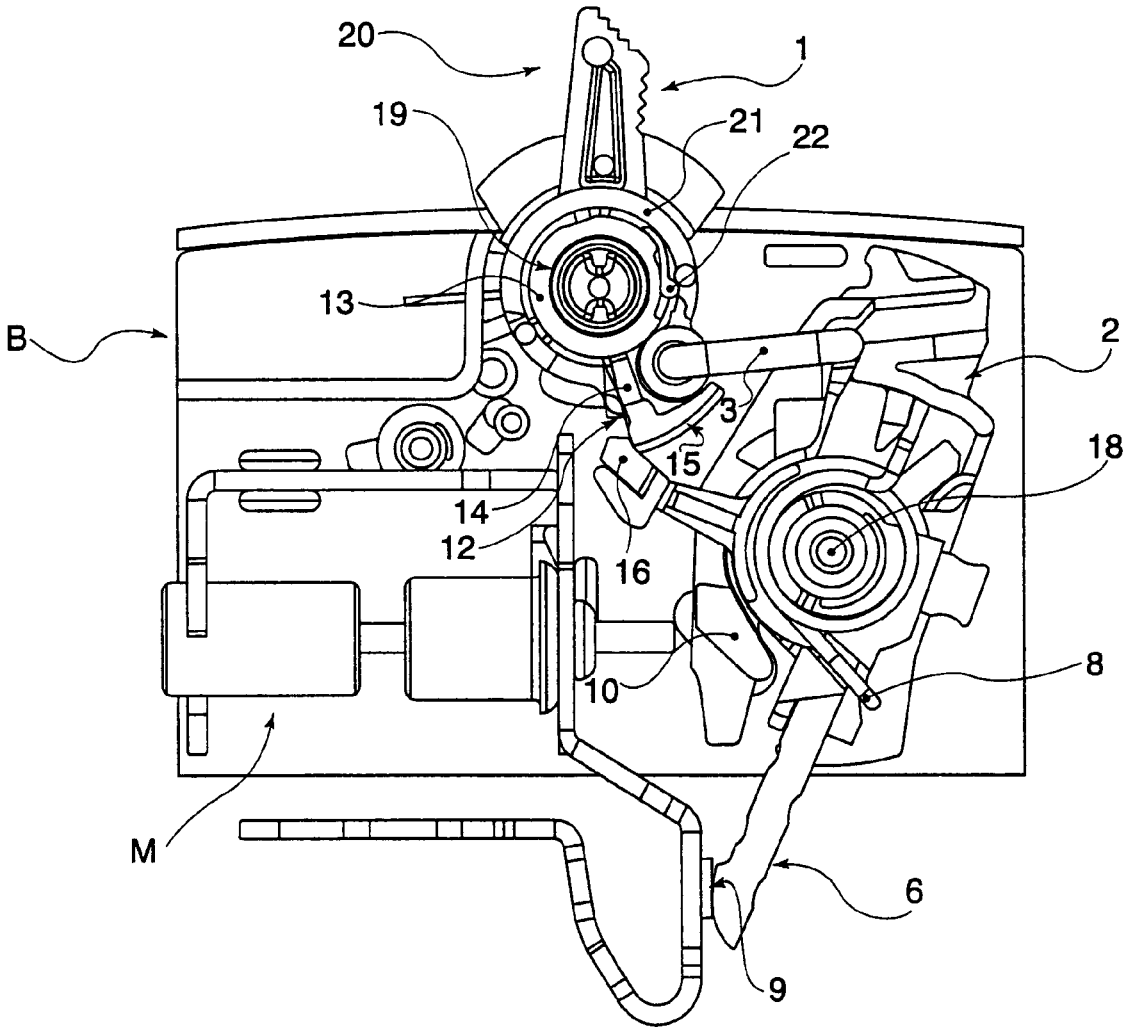
Figure 5E:
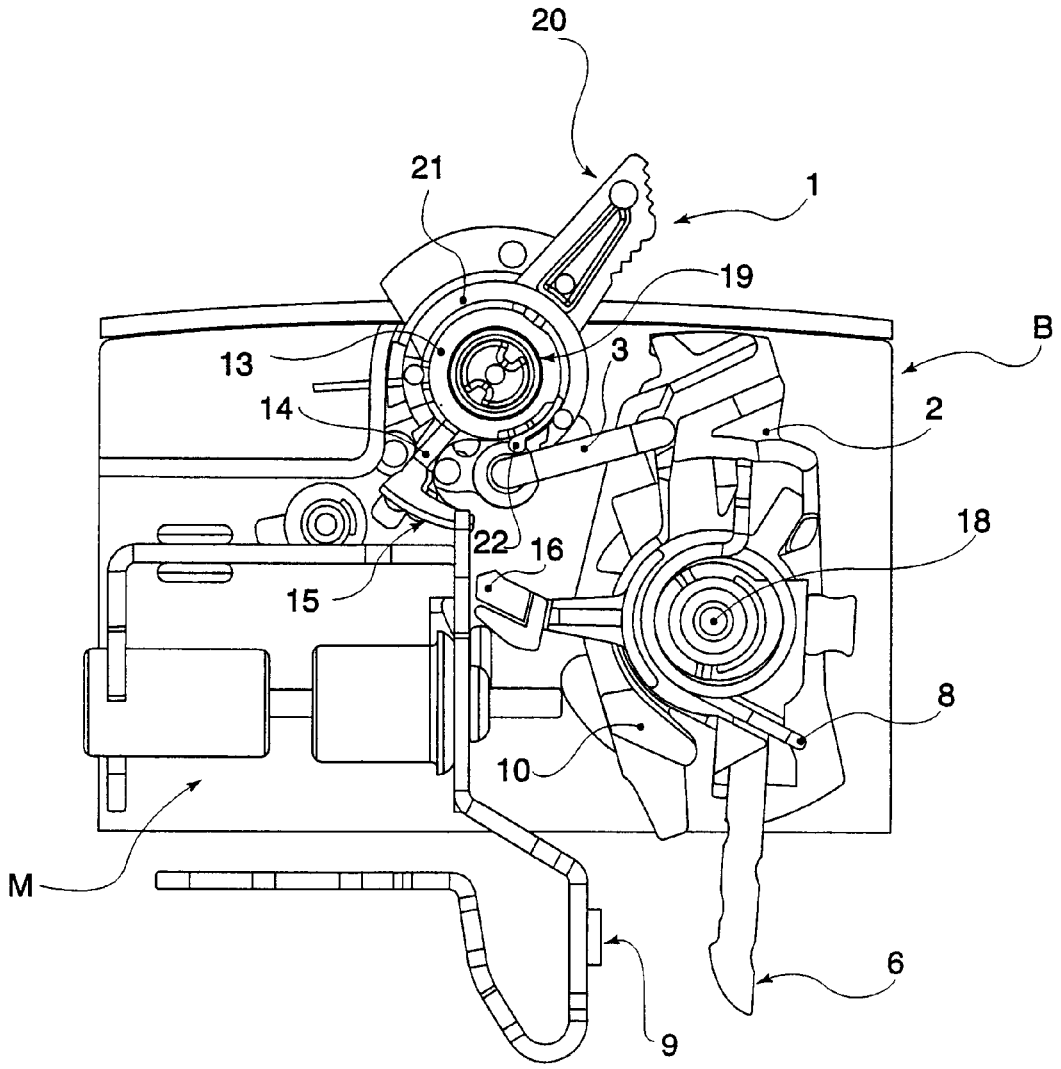

FIGS. 5*a* to 5*e* show a reverse cycle, i.e. one by which the contacts (6, 9) are opened. FIGS. 5*a* to 5*b* are therefore identical to FIGS. 4*f* and 4*g,* and must here be seen as the start of the opening cycle. Now, if the hand operating lever (1) is operated in the clockwise direction, as shown in FIG. 5*c,* the toggle operating mechanism actuates the contact support (2), and consequently the contact (6), in rotation in the counterclockwise direction. The contrary directions of the rotations, already observed in the closure cycle, have occasioned an intersection of the trajectories, which places the finger (16) in the opening trajectory of the projection (14). If the opening has to be forced, the engagement of the projection (14) and the finger (16) could cause damage to one or other of these components, or even premature wear prejudicial to operation.

It is for this reason that the elastic leg (22) is provided, since it intervenes at this stage of the opening to push back the projection (14) in an opposite rotational direction to that of the hand lever (1), for a very limited travel, due to the antagonistic effort created by the finger (16) while it is still in the normal trajectory of the projection (14). The difference between FIG. 5*c* and FIG. 5*d* resides in the positioning of the elastic leg (22), and consequently of the projection (14): in FIG. 5*c,* the elastic leg is not yet biased, while it is in abutment against the barrel (13) in FIG. 5*d.*

Pursuit of the reversed rotation of the hand operating lever (1) and of the contact support (2) supporting the movable electrical contact (6) then permits rotation of the projection (14) in the clockwise direction, as the rotary displacement of the finger (16) in the counterclockwise direction is sufficient to allow it passage.

In the absence of additional obstacles, the hand lever can again be brought into abutment against the opposite side of the upper opening in the casing D, in the position of opening of the contacts (6, 9).

The invention has been described using a particular configuration example, in particular of the cam and of the finger, which is fixedly attached to the movable electrical contact, which are however in no way limiting. On the contrary, the invention includes all the modifications of form and configuration, which are within the scope of a person skilled in the art.

What is claimed is:

1. A mechanism for rapid closure of electrical contacts for a modular electrical apparatus, the mechanism comprising:

a.) at least one fixed electrical contact (9);

b.) at least one movable electrical contact (5, 6), which cooperates with the at least one fixed electrical contact (9);

c.) a contact support (2), about which the at least one movable electrical contact (5, 6) is arranged in a rotationally pivoting relationship, and such that the contact support (2) is capable of rotational movement to position each movable electrical contact (5, 6) alternatively in contact with and out of contact with the at least one fixed electrical contact (9);

d.) at least one contact spring (7, 8), corresponding in number to the number of movable electrical contacts (5, 6), for biasing the position of each movable electrical contact (5, 6) in a rest position;

e.) a control lever (1), for moving the contact support (2) alternatively between two stable positions and for causing rotation of the contact support (2);

f.) a toggle system (3, 4), through which the contact support (2) is rotated; and g.) a rapid closure mechanism including a cam (12) and at least one finger (16, 17), the number of fingers corresponding to the number of movable electrical contacts (5, 6), such that the cam (12) and the at least one finger (16, 17) rotationally pivot respectively with the control lever (1) and the at least one movable electrical contact (5, 6), with both the cam (12) and the at least one finger (16, 17) each describing a circular path, such that the path of the cam (12) coincides with the paths of the at least one finger (16, 17) during a coincident phase of the simultaneous rotation of the cam (12) and the at least one finger (16, 17), during which coincident phase the cam (12) and each of the at least one finger (16, 17) are cooperatively engaged in order to lock the at least one movable electrical contact (5, 6) at a distance from the at least one fixed electrical contact (9), such that rapid closure of the electrical contact occurs at the end of the coincident phase of the simultaneous rotation of the cam (12) and the at least one finger (16, 17), and further such that closure of the at least one movable electrical contact (5, 6) and the at least one fixed electrical contact (9) occurs at a speed that is independent of a speed of rotation applied to the control lever (1), when rotational movements in opposing directions are imparted to the control lever (1) and the at least one movable electrical contact (5, 6), to thereby cause an intersection of the respective paths of the cam (12) and the at least one finger (16, 17), which move substantially in the same direction, driven respectively by the control lever (1), which is free to rotate through a limited range relative to the cam (12), and the at least one finger (16, 17), which are fixedly attached to corresponding ones of the at least one movable electrical contact (5, 6), with the positioning of the at least one finger (16, 17) relative to the cam (12) and to the at least one movable electrical contact (5, 6), respectively, being such that the at least one finger (16, 17) and the cam (12) enter into contact when the at least one fixed electrical contact (9) and the at least one movable electrical contact (5, 6) are spaced apart, with the cam (12) having a surface (15) of such form and length that the at least one finger (16, 17) is rotationally locked during a portion of rotation of the control lever (1) that is less than a portion of its residual travel required to reach a stable position of closure of the at least one movable electrical contact (5, 6) and the at least one fixed electrical contact (9), with the contact support (2) however continuing its path of travel while the contact spring (7, 8) accumulates energy, which is released only when contact between the cam (12) and the at least one finger (16, 17) ceases, and such that during a final portion of travel of the control lever (1), the cam (12) is able to continue its rotation relative to the control lever (1), an angular range of rotation of the cam (12) being limited by a stop on the control lever (1) engaging an elastic element (22) on the cam (12), which is interposed between the cam (12) and the stop.

2. The mechanism according to claim 1, wherein the cam (12) includes a barrel (13) with a hollow cylindrically shaped surface, such that the barrel turns about a central spindle (19) at the center of a drum (21) provided with a radial lever (20), which together form the control lever (1), the drum (21) including an aperture arranged substantially opposite the radial lever (20) and permitting passage of a radial projection (14) of the cam (12) extending from the barrel (13), a free end of which widens and includes an outer surface (15) coaxial with the cylindrically shaped surface of the barrel (13), the edges of the aperture parallel to a generatrix of the drum (21) forming the stops between which the cam (12) is free to rotate.

3. The mechanism according to claim 2, wherein the elastic element (22) includes a leg (14), which is fixed at one end to the outer surface of the barrel (13) of the cam (12) and diverges progressively outward in a direction towards an opposite free end of the leg, such that the leg (14) first contacts each of the at least one finger (16, 17) on closure of the at least one movable electrical contact (5, 6) and the fixed electrical contact (9).

4. The mechanism according to claim 3, wherein the at least one finger (16, 17) that is fixedly attached to a corresponding one of the at least one movable electrical contact (6, 5), is situated between the at least one movable electrical contact (5, 6) and the control lever (1), and is formed by over-molding the at least one movable electrical contact (5, 6) with an insulating material.

5. The mechanism according to claim 4, wherein the at least one finger (16, 17) that is fixedly attached to a corresponding one of the at least one movable electrical contact (6, 5), is situated between the at least one movable electrical contact (6, 5) and the control lever (1), and is formed by over-molding the at least one movable electrical contact (5, 6) with an insulating material.

6. The mechanism according to claim 1, wherein the at least one finger (16, 17) that is fixedly attached to a corresponding one of the at least one the movable electrical contact (5, 6), is positioned between the at least one movable electrical contact (5, 6) and the control lever (1), and is formed by over-molding the at least one movable electrical contact (5, 6) with an insulating material.

7. The mechanism according to claim 1, wherein the cam (12) for a neutral phase apparatus is identical to that of a single phase apparatus, with the outer surface (15) of the cam (12), which contacts each of the at least one finger (16, 17) associated with each movable electrical contact (6, 5), being formed with a sufficient width to simultaneously cooperate with two fingers (16, 17), thereby ensuring simultaneous tripping of both the two phase and neutral movable electrical contacts (5, 6).

8. The mechanism according to claim 1, wherein the control lever (1) is manually actuated.

* * * * *